US007587964B2

(12) United States Patent
Hellström et al.

(10) Patent No.: US 7,587,964 B2
(45) Date of Patent: Sep. 15, 2009

(54) PNEUMATIC POWER WRENCH WITH PRE-SET TORQUE LEVELS

(75) Inventors: Tore Gunnar Hellström, Enebyhberg (SE); Lars Torsten Roger Wiberg, Strängnäs (SE)

(73) Assignee: Atlas Copco Tools AB, Nacka (SE)

( * ) Notice: Subject to any disclaimer, the term of this patent is extended or adjusted under 35 U.S.C. 154(b) by 0 days.

(21) Appl. No.: 11/792,430

(22) PCT Filed: Dec. 5, 2005

(86) PCT No.: PCT/SE2005/001833

§ 371 (c)(1),
(2), (4) Date: Jul. 19, 2007

(87) PCT Pub. No.: WO2006/062463

PCT Pub. Date: Jun. 15, 2006

(65) Prior Publication Data

US 2008/0115635 A1 May 22, 2008

(30) Foreign Application Priority Data

Dec. 7, 2004 (SE) ..... 0402971

(51) Int. Cl.
*B25B 23/151* (2006.01)
*B25B 23/14* (2006.01)

(52) U.S. Cl. ..... 81/470; 73/862.21

(58) Field of Classification Search ..... 81/470, 81/469, 467, 472, 477, 478, 480, 473, 475, 81/476, 483, DIG. 5; 73/862.21, 862.22
See application file for complete search history.

(56) References Cited

U.S. PATENT DOCUMENTS

| | | | | |
|---|---|---|---|---|
| 3,403,551 | A | 10/1968 | Agostini | |
| 3,955,662 | A | 5/1976 | Thackston | |
| 3,956,905 | A | 5/1976 | Thackston | |
| 4,088,197 | A | 5/1978 | Roll et al. | |
| 4,113,080 | A * | 9/1978 | Thackston et al. | 192/150 |
| 4,207,783 | A * | 6/1980 | Grabovac | 81/483 |
| 6,640,674 | B1 * | 11/2003 | Rinner et al. | 81/475 |
| 6,722,235 | B2 * | 4/2004 | Hsieh | 81/478 |
| 6,945,144 | B1 | 9/2005 | Cutler et al. | |

FOREIGN PATENT DOCUMENTS

| | | |
|---|---|---|
| GB | 1 522 699 | 8/1978 |

* cited by examiner

*Primary Examiner*—Hadi Shakeri
(74) *Attorney, Agent, or Firm*—Frishauf, Holtz, Goodman & Chick, P.C.

(57) ABSTRACT

A pneumatic power wrench comprises a housing (10) with a pressure air supply passage (16), a motor (13) and an adjustable pressure responsive shut-off valve (17) located in the air supply passage (16) and including a valve element (21) and a bias spring (25) supported in one direction by the valve element (21) and in the opposite direction by a movable spring support (26), and a manually operated torque setting mechanism (31,32) for setting the spring support (26) in various positions, thereby varying the pre-tension of the spring (25) a swell as output torque level of the motor (13), wherein the setting mechanism (31,32) comprises an adjustment unit (32) which is rotatively journalled in the housing (10) and carrying two or more adjustable stop elements (31) arranged to be selectively brought into engagement with the spring support (26) and individually set at different positions corresponding to desired different output torque levels of the wrench.

16 Claims, 2 Drawing Sheets

PNEUMATIC POWER WRENCH WITH PRE-SET TORQUE LEVELS

This application is a U.S. National Phase Application under 35 USC 371 of International Application PCT/SE2005/001833 filed Dec. 5, 2005.

The invention relates to a pneumatic power wrench which includes a motor, and a pressure responsive shut-off valve located in the pressure air supply passage to the motor for limiting the output torque of the motor, wherein the pressure shut-off valve has a bias spring which is supported in one direction by a valve element and in the opposite direction by a movable spring support, and a manually operated torque setting mechanism which is arranged to set the position of the spring support in various positions to thereby vary the tension of the bias spring and, hence, the output torque from the motor.

In this type of power wrench a change in torque output is obtained by manual re-setting of the shut-off valve. When using a wrench of this type at a working site where a number of different types of screw joints are to be tightened to different torque levels the shut-off valve has to be re-set when moving the wrench from one type of screw joint to another. Such re-setting procedures are rather time consuming. An alternative way of action would be to use two or more wrenches all set at different torque output levels.

In order to simplify the work at a working site as described above avoiding repeated re-setting of one power wrench for the different types of screw joint or avoiding use of more than one wrench for the job the present invention provides a new type of pneumatic power wrench offering a quick and easy shifting between two or more pre-set torque levels.

A preferred embodiment of the invention is described below in detail with reference to the accompanying drawings.

Figure 1:
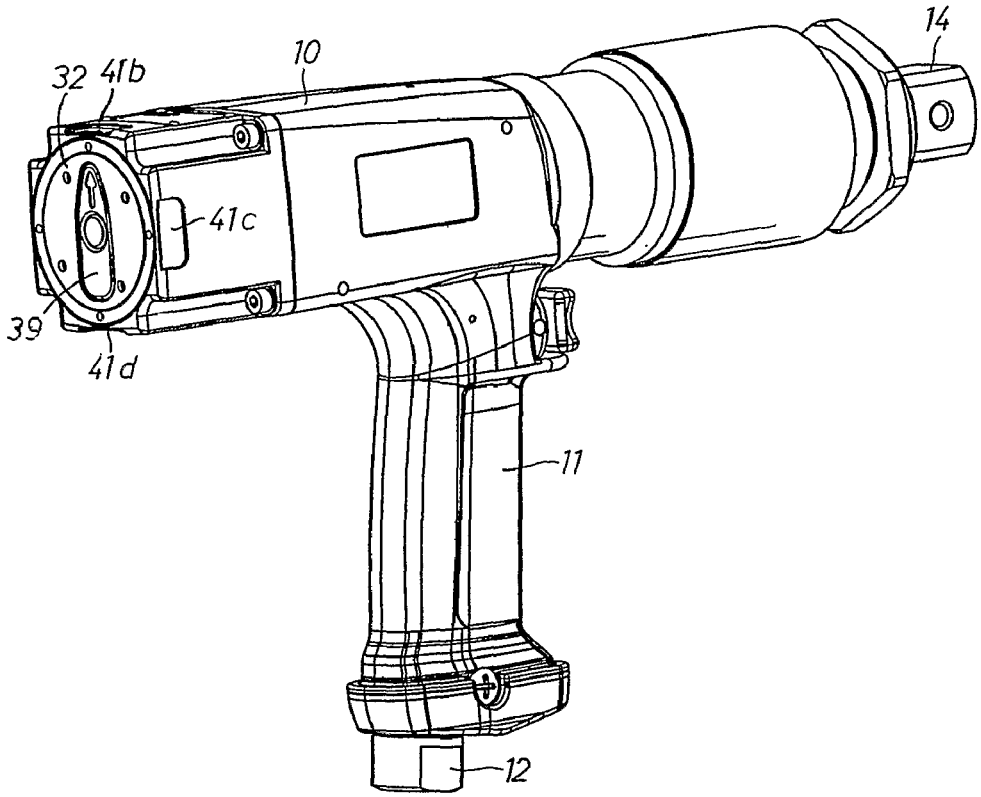
FIG. 1 shows a perspective view of a power wrench according to the invention.

The power wrench shown in the drawing figures comprises a housing 10 with a pistol type handle 11, and a connection 12 for a pressure air conduit at the lower end of the handle 11. The wrench comprises a pneumatic motor 13 which is coupled to an output shaft 14 via a non-disclosed reduction gearing. The motor 13 is supplied with pressure air via an inlet port 15 and an air supply passage 16 in the housing 10, and a torque limiting pressure responsive shut-off valve 17 is located in the pressure air supply passage 16 and arranged to shut off the motor 13 at a desired predetermined torque level. A certain counter pressure level in the motor inlet port 15 corresponds to a certain motor torque level and, hence, a certain output torque level on the output shaft 14.

The shut-off valve 17 comprises a tubular valve casing 20 mounted in the housing 10, and an axially movable valve element 21. The valve casing 20 is formed with a rear end surface 22 for sealing co-operation with the valve element 21 in a closed position of the valve 17. In its open position the valve element 21 co-operates with an elastic seal ring 23 for sealing off a rear end surface 24 of the valve element 21, thereby preventing the pressure air in the supply passage 16 from reaching and acting on the end surface 24. The valve element 21 is biased against the seal ring 23 by a spring 25 which acts between an adjustable spring support 26 and cap member 27 supported at one end of a valve element push rod 28 and a screw 29 secured to the valve element 21. The space inside the seal ring 23 communicates continuously with the inlet port 15 via a control passage 18 so as to balance the valve element 21 between the spring 25 and the counter pressure in the motor inlet port 15. It is evident that the harder the spring 25 is pre-tensioned the higher pressure from the motor inlet port 15 and the higher output torque of the motor 13 is required to move the valve element 21 towards closed position.

The spring support 26 is provided with a roller 30 and is backed by either one of four identical adjustable stop elements 31 which are carried on an adjustment unit 32. The latter forms a torque setting mechanism and is rotatively supported in the housing 10 about an axis A. Each stop element 31 comprises a contact block 33 having a central spindle 34 engaged by a set screw 35. The contact block 33 is formed with a double cam profile 36 for co-operation with the roller 30 on the spring support 26. See FIG. 3. The contact block 33 is formed with a central notch 38 to engage the spring support roller 30 to thereby arrest the adjustment unit 32 in a correct position relative to the spring support 26. The adjustment unit 32 is manually rotated between four distinct angular positions, defined by the notch 38 on each contact block 33, to put one at a time of the stop elements 31 into engagement with the spring support 26. At its rear end surface the adjustment unit 32 has a maneuver knob 39 which is foldable not to cause any unintentional shifting of the adjustment unit 32. The maneuver knob 39 has a position indicator in the form of an arrow 40, and the housing 10 is provided with four marking surfaces 41*a-d* where the actual torque setting for each position of the adjustment unit 32 can be marked.

Each one of the stop elements 31 is individually set by the screw 35 to accomplish a certain pretension of the spring 25 and to, thereby make the shut-off valve element 21 shift to closed position at a certain air pressure in the motor inlet port 15. In other words, the different stop elements 31 are set to make the wrench deliver four different torque levels. You just have to rotate the adjustment unit 32 to align the stop element 31 that has been set to a certain torque level with the spring support 26. It is to be noted that each one of the stop elements 31 is adjustable between a maximum torque output position and a minimum torque output position, which means that any desired torque level within the entire torque range of the wrench is available to the operator in each position.

When preparing the wrench for operation, the different stop elements 31 of the adjustment unit 32 are individually set at four different positions meeting the torque level requirements of four different screw joints to be tightened. This is obtained by adjusting the set screws 35. The set torque level for each stop element 31 is marked on the respective marking surface 41*a-d* on the housing 10 on which the arrow 40 points. Each setting of the set screw 35 makes the spring support 26 pretension the spring 25 to a certain extent to thereby exert a bias force on the cap 27, the rod 28, the screw 29 and the valve element 21. The valve element 21 is urged against the seal ring 23 and leaves an annular air flow opening relative to the valve casing end surface 22. The seal ring 23 prevents pressure air from the supply passage 16 from reaching the rear end surface 24 of the valve element 21, and since at the start of a tightening cycle there is no pressure in the motor inlet port 15 and the control passage 18 the bias force of the spring 25 will be unchallenged and the valve element 21 will be kept in its open position.

Figure 5:
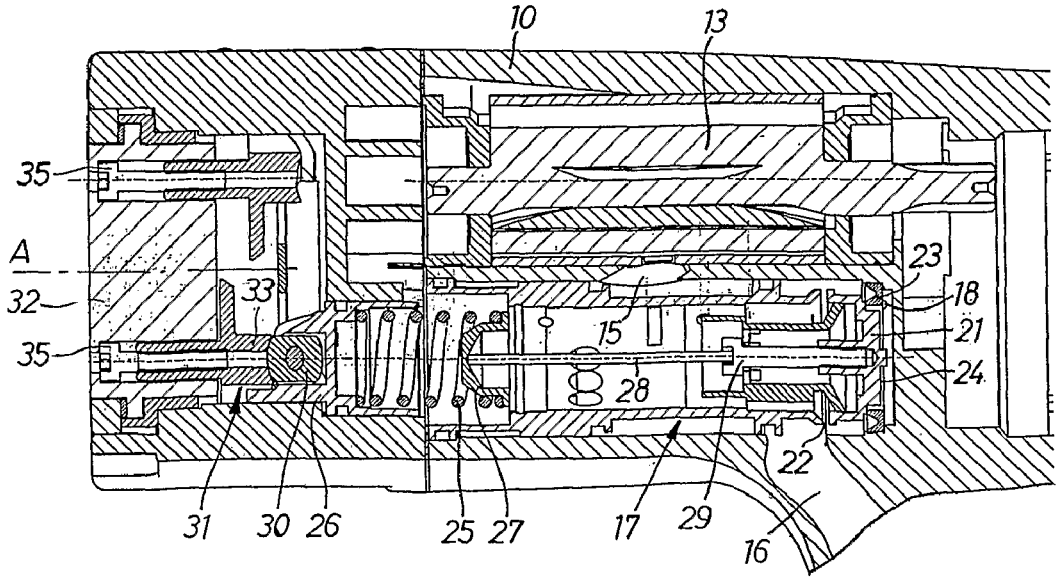
FIG. 5 shows a longitudinal section through the shut-off valve and an adjustable stop element according to the invention.
Figure 3:
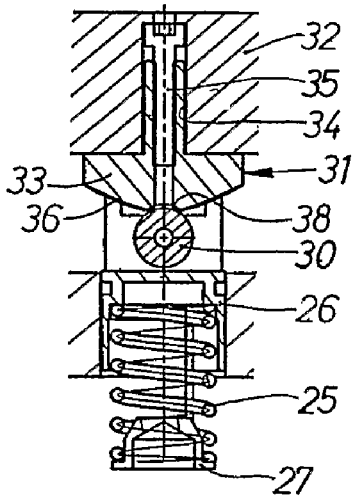
FIG. 3 shows a longitudinal section through the spring support and a stop element as indicated by line III-III in FIG. 4.
Figure 2:
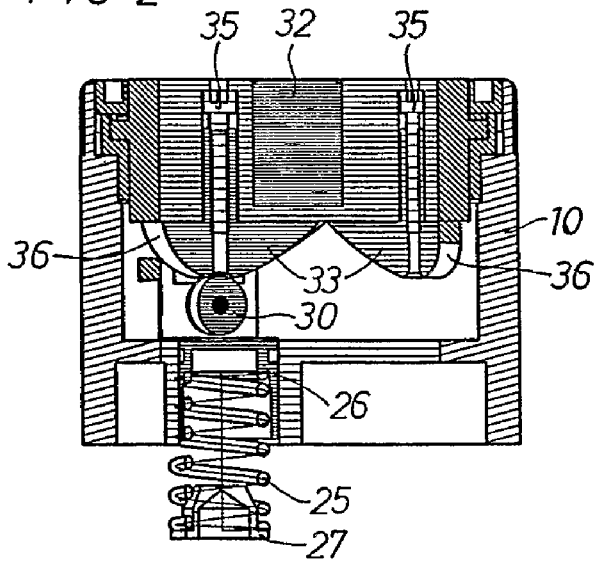
FIG. 2 shows a longitudinal section through the torque setting mechanism of the power wrench in FIG. 1.
Figure 4:
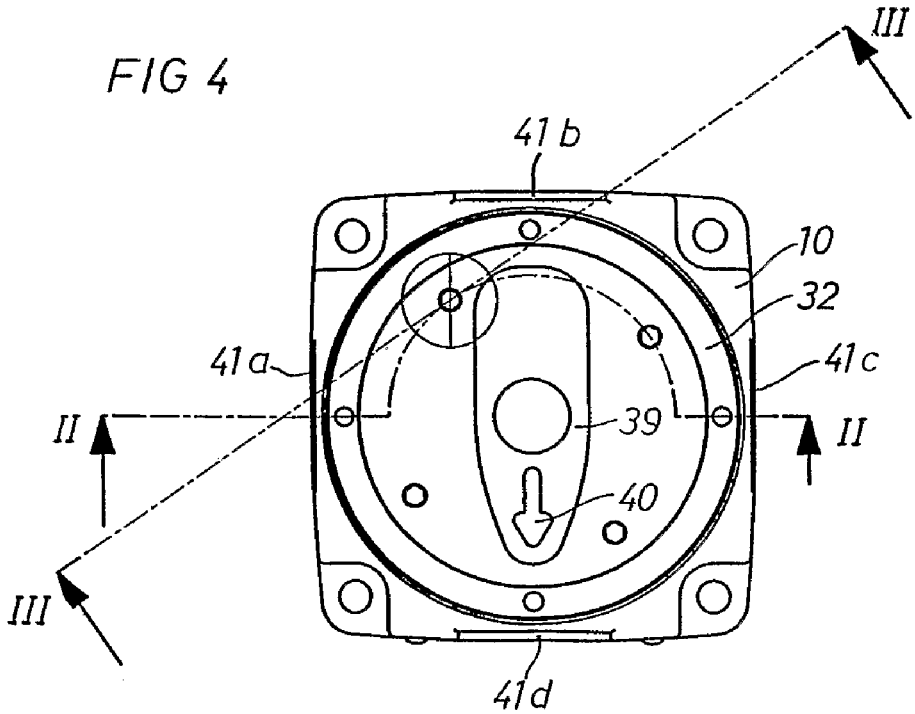
FIG. 4 shows a rear end view of a power wrench according to the invention.

It is to be observed that in FIGS. 2, 3, and 5 the set screws 35 are set to give a minimum torque output from the power wrench, i.e. the stop elements 31 occupy their most retracted positions.

At the start of a screw joint tightening cycle pressure air is fed through the supply passage 16 into the valve casing 20, through the annular opening past the rear end surface 22 of the casing 20 and through the motor inlet port 15. The motor starts operating to deliver an output torque to the output shaft 14 and to the screw joint to be tightened. As the torque resistance in the screw joint becomes higher the counter pressure in the motor inlet port 15 and the control passage 18 increases and, accordingly, the pressure acting on the rear end surface 24 of the valve element 21. When the torque resistance in the screw joint has reached the intended final torque level the air pressure communicated to the rear end surface 24 of the valve element 21 via passage 18 will dominate the bias force of the spring 25 such that the valve element 21 will start moving towards closed position. As soon as the valve element 21 has separated from the seal ring 23 the even higher supply pressure in passage 16 will reach the rear end surface 24 of the valve element 21. This results in an increased closing force on the valve element 21, and the pressure air supply to the motor 13 is distinctly shut off, i.e. the valve element 21 is brought into sealing engagement with the end surface 22 of the valve casing 20.

The above described operation order of the shut-off valve 17 is the same no matter the set torque level or which one of the stop elements 31 is actually brought into co-operation with the spring support 26. Just by rotating the adjustment unit 32 into different positions four pre-set torque levels are readily available to the operator. This means a considerable time saving when working at a site where a number of screw joints of different sizes have to be tightened to different final torque levels.

The invention claimed is:

1. A pneumatic power wrench, comprising:

a housing with a pressure air supply passage, a motor, an adjustable pressure responsive shut-off valve located in the pressure air supply passage for limiting an output torque of the motor, said shut-off valve including a valve element, and a bias spring supported in one direction by the valve element and in an opposite direction by a movable spring support, and a manually operated torque setting mechanism arranged to set a position of said spring support in various positions, thereby varying a pre-tension of the spring for obtaining different output torque levels of the motor, wherein said torque setting mechanism comprises an adjustment unit rotatively journalled in the housing for rotation about an axis located at a lateral distance from said shut off valve and carrying two or more adjustable stop elements arranged to be selectively brought into engagement with said spring support, wherein each of said stop elements comprises a set screw for individual pre-setting of said stop elements at different positions corresponding to desired different output torque levels of the power wrench, and wherein each of said stop elements comprises a contact block with cam profiles that is coupled to said set screw and arranged to engage said spring support.

2. The power wrench according to claim 1, wherein said stop elements are located on said adjustment unit on a common circle concentric with said rotation axis.

3. The power wrench according to claim 2, wherein said adjustment unit comprises a position indicator, and the housing has markings indicating the different positions of the adjustment unit and, hence, the different pre-set torque output levels such that alignment of said indicator and one of said markings indicates what torque output level is actually chosen.

4. The power wrench according to claim 2, wherein each one of said stop elements is adjustable between a max-position making the shut-off valve provide a maximum torque output of the power wrench, and a min-position making the shut-off valve provide a minimum torque output of the power wrench.

5. The power wrench according to claim 4, wherein said spring support is provided with a rolling element, and each one of said contact blocks is formed with a notch to be engaged by said rolling element to define a correct setting position of said adjustment unit relative to the spring support for each desired torque output level.

6. The power wrench according to claim 5, wherein said adjustment unit comprises a position indicator, and the housing has markings indicating the different positions of the adjustment unit and, hence, the different pre-set torque output levels such that alignment of said indicator and one of said markings tells what torque output level is actually chosen.

7. The power wrench according to claim 4, wherein said adjustment unit comprises a position indicator, and the housing has markings indicating the different positions of the adjustment unit and, hence, the different pre-set torque output levels such that alignment of said indicator and one of said markings tells what torque output level is actually chosen.

8. The power wrench according to claim 2, wherein said spring support is provided with a rolling element, and each one of said contact blocks is formed with a notch to be engaged by said rolling element to define a correct setting position of said adjustment unit relative to the spring support for each desired torque output level.

9. The power wrench according to claim 8, wherein said adjustment unit comprises a position indicator, and the housing has markings indicating the different positions of the adjustment unit and, hence, the different pre-set torque output levels such that alignment of said indicator and one of said markings tells what torque output level is actually chosen.

10. The power wrench according to claim 1, wherein each one of said stop elements is adjustable between a max-position making the shut-off valve provide a maximum torque output of the power wrench, and a min-position making the shut-off valve provide a minimum torque output of the power wrench.

11. The power wrench according to claim 10, wherein said spring support is provided with a rolling element, and each one of said contact blocks is formed with a notch to be engaged by said rolling element to define a correct setting position of said adjustment unit relative to the spring support for each desired torque output level.

12. The power wrench according to claim 11, wherein said adjustment unit comprises a position indicator, and the housing has markings indicating the different positions of the adjustment unit and, hence, the different pre-set torque output levels such that alignment of said indicator and one of said markings tells what torque output level is actually chosen.

13. The power wrench according to claim 10, wherein said adjustment unit comprises a position indicator, and the housing has markings indicating the different positions of the adjustment unit and, hence, the different pre-set torque output levels such that alignment of said indicator and one of said markings tells what torque output level is actually chosen.

14. The power wrench according to claim 1, wherein said spring support is provided with a rolling element, and each one of said contact blocks is formed with a notch to be engaged by said rolling element to define a correct setting position of said adjustment unit relative to the spring support for each desired torque output level.

15. The power wrench according to claim 14, wherein said adjustment unit comprises a position indicator, and the housing has markings indicating the different positions of the adjustment unit and, hence, the different pre-set torque output levels such that alignment of said indicator and one of said markings tells what torque output level is actually chosen.

16. The power wrench according to claim 1, wherein said adjustment unit comprises a position indicator, and the housing has markings indicating the different positions of the adjustment unit and, hence, the different pre-set torque output levels such that alignment of said indicator and one of said markings tells what torque output level is actually chosen.

* * * * *